US005135177A

United States Patent [19]

Okuhara

[11] Patent Number: 5,135,177

[45] Date of Patent: Aug. 4, 1992

[54] CHIP PLATE IN THE ROTOR OF A CENTRIFUGAL CRUSHER

[75] Inventor: Seiichiro Okuhara, Hiroshima, Japan

[73] Assignee: Kotobuki Engineering & Manufacturing Co., Ltd., Tokyo, Japan

[21] Appl. No.: 619,303

[22] Filed: Nov. 28, 1990

[30] Foreign Application Priority Data

Apr. 17, 1990 [JP] Japan ..... 2-41293[U]

[51] Int. Cl.[5] ..... B02C 19/00

[52] U.S. Cl. ..... 241/275

[58] Field of Search ..... 241/275

[56] References Cited

U.S. PATENT DOCUMENTS

| | | | |
|---|---|---|---|
| 3,970,257 | 7/1976 | MacDonald et al. | 241/275 |
| 4,586,663 | 5/1986 | Bartley | 241/275 X |
| 4,834,298 | 5/1989 | Murata et al. | 241/275 X |
| 4,896,838 | 1/1990 | Vendelen et al. | 241/275 |

*Primary Examiner*—Mark Rosenbaum
*Assistant Examiner*—Frances Chin
*Attorney, Agent, or Firm*—Flynn, Thiel, Boutell & Tanis

[57] ABSTRACT

This invention relates to a chip plate provided at the outlet on the circumference of the rotor of a centrifugal crusher. The cemented carbide chip embedded in the chip plate is the either rounded or sloped in the internal part of its tip and, even if the cemented carbide chip is exposed as a result of wear and a mass of rock hits against it, the impact of collision is softened because the said mass of rock rushes out by slipping on it, thus preventing breaking of the cemented carbide chip.

6 Claims, 2 Drawing Sheets

CHIP PLATE IN THE ROTOR OF A CENTRIFUGAL CRUSHER

BACKGROUND OF THE INVENTION

1. Field of the Invention

This invention relates to the rotor, especially a chip plate provided at the outlet on the circumference of the rotor, of a centrifugal crusher which crushes an object of crushing such as rock, etc., supplied into the center of a rotor rotating at a high speed, by sending it with a centrifugal force in the tangential direction from the outlet provided on the circumference of the rotor and making it strike against either a metallic crushing face or a dead bed formed by the crushed object of crushing.

2. Prior Art

There is a well known centrifugal crusher which crushes an object of crushing sent from the rotor by making it strike against a metallic crushing face provided around the rotor. Another type of centrifugal crusher provided with a dead bed formed by the crushed pieces of the object of crushing around the rotor is also known by U.S. Pat. No. 3,970,257.

In both types, the rotor of the centrifugal crusher has a pair of disks (upper and lower) and a wall plate which forms a passage connecting the two disks and leading to the outlet on the circumference, and is so designed as to crush an object of crushing supplied into the central part by sending it in the tangential direction after moving it up to the outlet with a centrifugal force and making it strike against either a metallic crushing face or a dead bed around the rotor, and a chip plate in which a cemented carbide chip installed facing the inside diagonally for prevention of wear of the outlet is provided near the outlet against which the object of crushing that moves while being pressed by the action of a centrifual force against the wall face of the passage is most strongly pressed.

In the above rotor, the tip of the chip plate wears because the object of crushing rushing out from the outlet passes while rubbing the tip of the chip plate (the part indicated with dotted lines in the drawing relating to the prior art indicates the worn part), while a cemented carbide chip of a high hardness with very little wear gradually gets exposed and eventually protrudes at the tip of the chip plate. As a result, the mass of the object of crushing comes to directly collide with the cemented carbide chip as it rushes out, and the cemented carbide chip which lacks in tenacity sometimes cracks or suffers from falling of a cracked part when a mass hits against it.

The purpose of the present invention is to solve the above problem i.e. prevent cracking or falling down of the cemented carbide chip.

SUMMARY OF THE INVENTION

In a preferred embodiment, the cemented carbide chip according to the present invention has the internal corner of its tip either rounded or sloped by chamfering.

In another preferred embodiment, the tip of the cemented carbide chip is either rounded or sloped from the inner side up to the chip plate.

With the cemented carbide chip by the present invention, even if a mass of object of crushing hits against the tip of the cemented carbide chip exposed as a result of wear of the chip plate, the impact of collision is softened since the said mass of object of crushing rushes out by slipping on the rounded or sloped part of the cemented carbide chip, and the rounding or sloping of the cemented carbide chip serves to reduce the projecting quantity of the cemented carbide chip even if the chip plate wears.

DETAILED DESCRIPTION OF THE PREFERRED EMBODIMENTS

Figure 1:
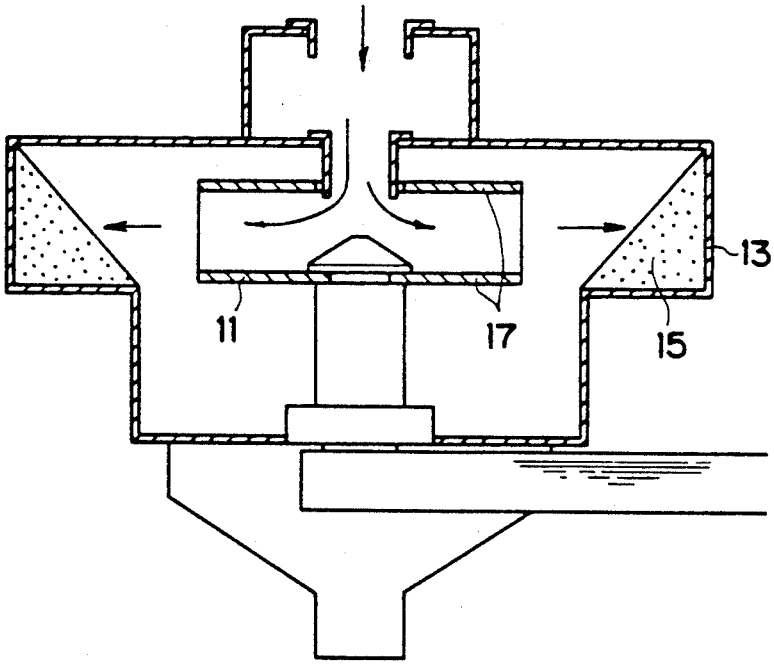
FIG. 1 is a sectional view of a centrifugal crusher which is provided with a dead bed formed by the crushed pieces of the object of crushing around the rotor.

The centrifugal crusher indicated in FIG. 1 is a type which has a rotor 11 driven at a high speed by a motor (not shown) and a crushing chamber 13 provided around the rotor. The crusher crushes the material, such as rock, etc., supplied from above at center of the rotor 11, by sending it with a centrifugal force in the tangential direction from the outlet provided on the circumference of the rotor and making it strike against a dead bed 15 formed by the crushed pieces accumulated in the crushing chamber.

Figure 2:
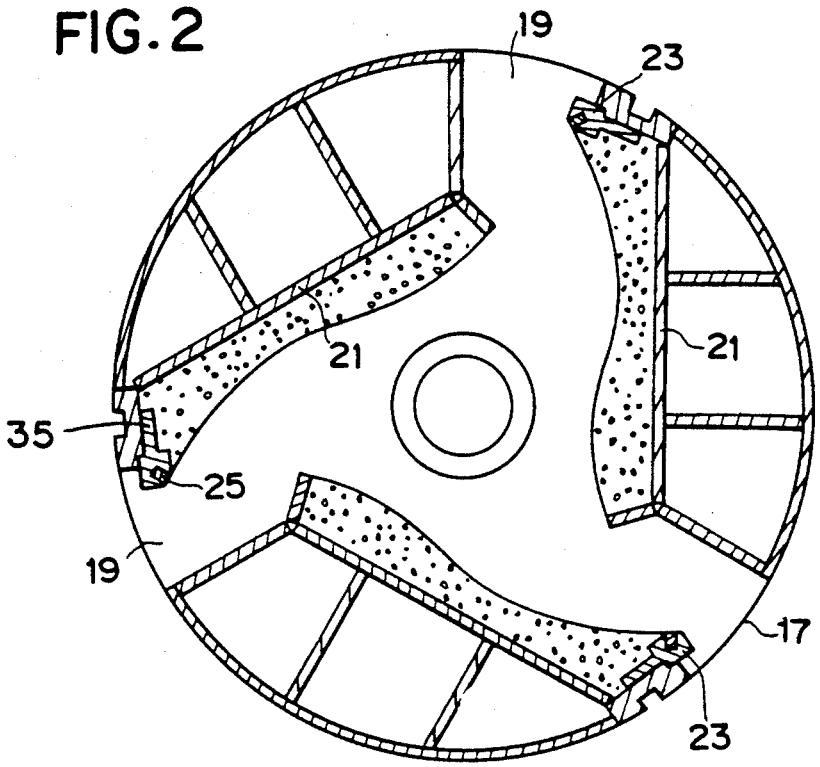
FIG. 2 is a sectional view of the rotor.

The rotor 11, as shown in FIG. 2, has a pair of disks (upper and lower) 17 and a wall plate 21 which forms a passage connecting two disks and leading to the outlet 19 on the circumference, and is so designed as to send the material supplied to the center in the tangential direction after moving it to the outlet with centrifugal force. A chip plate 23, embedded with a cemented carbide chip for prevention of wear of the outlet, is provided at the outlet 19 against which the material that moves while being pressed by the action of a centrifugal force against the wall face of the passage is most strongly pressed.

The cemented carbide chip 25 embedded at the tip of the chip plate 23 has an outer wall 39 with an inner longitudinal edge rounded 27 by chamfering. A first longitudinal edge 41 of the chip plate 23 is also rounded by chamfering, and the groove 29 formed by the two chamfered parts is preferably filled with a filler to disappear.

Figure 3:
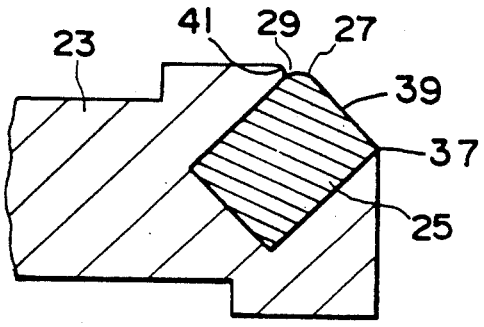
FIG. 3 is an expanded sectional view of the tip of the chip plate.
Figure 4:
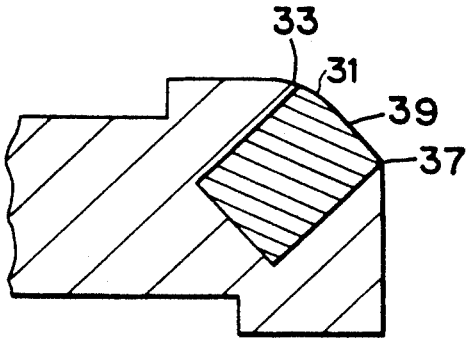
FIG. 4 is an expanded sectional view of the tip of the chip plate of another embodiment.
Figure 5:
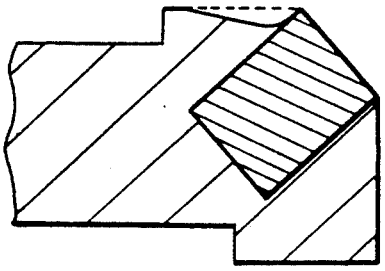
FIG. 5 PRIOR ART
FIG. 5 is an expanded sectional view of prior art.

The chip plate indicated in FIG. 4 has its internal corner, formed by the tip inner longitudinal edge of outer wall 39 and a first wall portion 33 of the chip plate, rounded 31 by chamfering. The chip plate 23 has a mounting portion 35 at an inner longitudinal end thereof. The outer wall 39 of chip 25 has an outer longitudinal edge 37 which is offset longitudinally outwardly from the chamfered inner longitudinal edge thereof. Aside from the chamfered parts shown in FIGS. 3 and 4, the remainder of the outer wall 39 is flat. Considering the aforementioned longitudinal edges of outer wall 39, the chamfered inner longitudinal edge is closer to the mounting portion 35, and the outer longitudinal edge 37 is more remote from the mounting portion 35.

What is claimed is:

1. In a centrifugal crusher for crushing a charge stock, a rotor adapted to be rotated at a high speed, said rotor having a central port for receiving the charge stock and a peripheral wall having at least one radial outlet opening therethrough, said rotor having a passage extending from said central port to said outlet opening whereby the charge stock fed into said central port flows to said outlet opening by centrifugal force and is discharged from said rotor in a tangential direction, and a chip plate assembly adjacent to the periphery of said rotor and extending partway across said outlet opening so that the charge stock will move across said chip plate assembly as it is being discharged from said outlet opening, the improvement which comprises: said chip plate assembly consists essentially of a single elongated blade having a mounting portion at an inner longitudinal end thereof, said mounting portion being mounted on said peripheral wall of said rotor, said blade having at an outer longitudinal end thereof an end portion which projects partway across said outlet opening, said end portion having an angular surface at a longitudinally outer end thereof over which surface the charge stock will pass in use, said surface having a recess therein, a cemented carbide chip fixed in said recess and having an outer wall constituting said angular surface, said outer wall having an inner longitudinal edge close to said mounting portion and an outer longitudinal edge remote from said mounting portion and offset longitudinally outwardly from said inner longitudinal edge, said inner longitudinal edge being chamfered prior to fixing said chip in said recess so as to be of rounded cross-sectional shape, the remainder of said outer wall being flat.

2. A centrifugal crusher as claimed in claim 1 in which said recess and said chip are of corresponding, generally rectangular, cross-sectional shape, said recess has a first longitudinal edge adjacent to said inner longitudinal edge of said cemented carbide chip, said first longitudinal edge also being rounded by chamfering whereby there is formed a groove between said first longitudinal edge of said recess and said inner longitudinal edge of said cemented carbide chip, and a filler material filling said groove.

3. A centrifugal crusher as claimed in claim 1 in which said end portion of said blade is of greater radial thickness than said mounting portion thereof, the radially inner surface of said end portion being radially inwardly offset from the radially inner surface of said mounting portion to provide a shoulder between said end portion and said mounting portion.

4. In a centrifugal crusher for crushing a charge stock, a rotor adapted to be rotated at a high speed, said rotor having a central port for receiving the charge stock and a peripheral wall having at least one radial outlet opening therethrough, said rotor having a passage extending from said central port to said outlet opening whereby the charge stock fed into said central port flows to said outlet opening by centrifugal force and is discharged from said rotor in a tangential direction, and a chip plate assembly adjacent to the periphery of said rotor and extending partway across said outlet opening so that the charge stock will move across said chip plate assembly as it is being discharged from said outlet opening, the improvement which comprises: said chip plate assembly consists essentially of a single elongate blade having a mounting portion at an inner longitudinal end thereof, said mounting portion being mounted on said peripheral all of said rotor, sid blade having at an outer longitudinal end thereof an end portion which projects partway across said outlet opening, said end portion having an angular surface at a longitudinally outer end thereof over which surface the charge stock will pass in use, said surface having a recess therin, a cemented carbide chip fixed in said recess and having an outer wall constituting said angular surface, said outer wall having an inner longitudinal edge close to said mounting portion and an outer longitudinal edge remote from said mounting portion and offset longitudinally outwardly from said inner longitudinal edge, a part of said outer wall being chamfered prior to fixing said chip in said recess so as to be of rounded cross-sectional shape in the region adjacent to said inner longitudinal edge, the remainder of said outer wall being flat.

5. A centrifugal crusher as claimed in claim 4 in which said recess and said chip are of corresponding, generally rectangular, cross-sectional shape, said end portion has a first wall portion adjacent to said outer wall of said cemented carbide chip, said first wall portion of said end portion also being rounded by chamfering, said first wall portion of said end portion being flush with and constituting a continuation of said chamfered outer wall of said chip.

6. A centrifugal crusher as claimed in claim 4 in which said end portion of said blade is of greater radial thickness than said mounting portion thereof, the radially inner surface of said end portion being radially inwardly offset from the radially inner surface of said mounting portion to provide a shoulder between said end portion and said mounting portion.

* * * * *

UNITED STATES PATENT AND TRADEMARK OFFICE

CERTIFICATE OF CORRECTION

PATENT NO. : 5 135 177

DATED : August 4, 1992

INVENTOR(S) : Seiichiro OKUHARA

It is certified that error appears in the above-identified patent and that said Letters Patent is hereby corrected as shown below:

Column 4, Line 15; change "all" to ---wall---.

Column 4, Line 15; change "sid" to ---said---.

Column 4, Line 21; change "therin" to ---therein---.

Signed and Sealed this

Fifth Day of October, 1993

Bruce Lehman

*Attest:*

BRUCE LEHMAN

*Attesting Officer*

*Commissioner of Patents and Trademarks*